US005107591A

United States Patent [19]

Sato

[11] Patent Number: 5,107,591

[45] Date of Patent: Apr. 28, 1992

[54] THINNING SCISSORS

[75] Inventor: Takashi Sato, Gardena, Calif.

[73] Assignee: Hikari Corporation, Gardena, Calif.

[21] Appl. No.: 678,052

[22] Filed: Apr. 1, 1991

[51] Int. Cl.[5] ..... B26B 19/22

[52] U.S. Cl. ..... 30/195; 30/254

[58] Field of Search ..... 30/195, 254, 30

[56] References Cited

U.S. PATENT DOCUMENTS 2,083,483 6/1937 Strezoff ..... 30/195

2,267,949 12/1941 Reed ..... 30/195

4,660,285 4/1987 Pracht ..... 30/195

*Primary Examiner*—Frank T. Yost

*Assistant Examiner*—C. Dexter

*Attorney, Agent, or Firm*—Spensley Horn Jubas & Lubitz

[57] ABSTRACT

Thinning scissors including a serrated blade wherein cutting teeth and non-cutting guides are spaced along the blade. The non-cutting guides will control the volume of hair to be cut in a thinning action without impairing artistic hair configurations.

16 Claims, 2 Drawing Sheets

FIG. 5
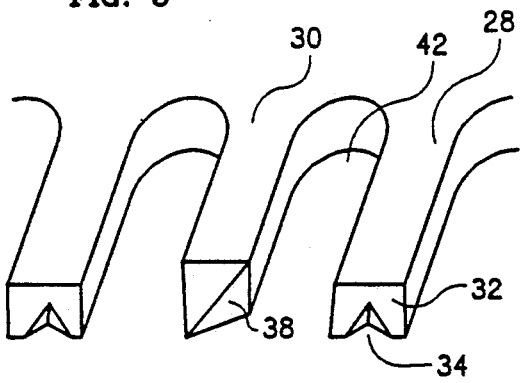
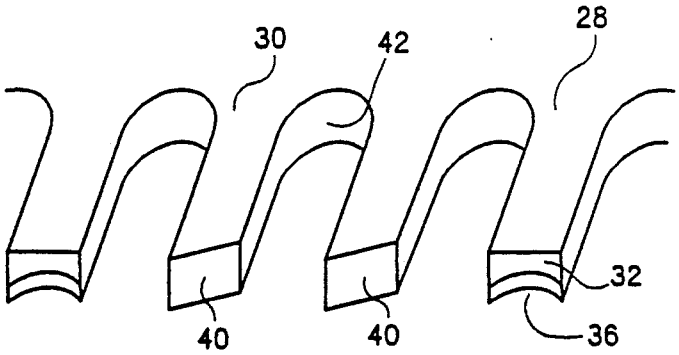
FIG. 6
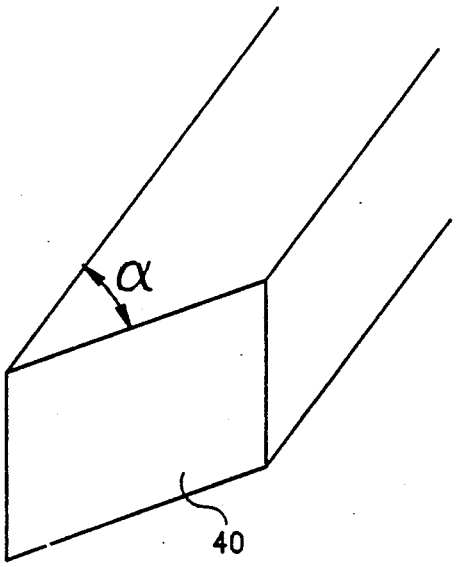
FIG. 7
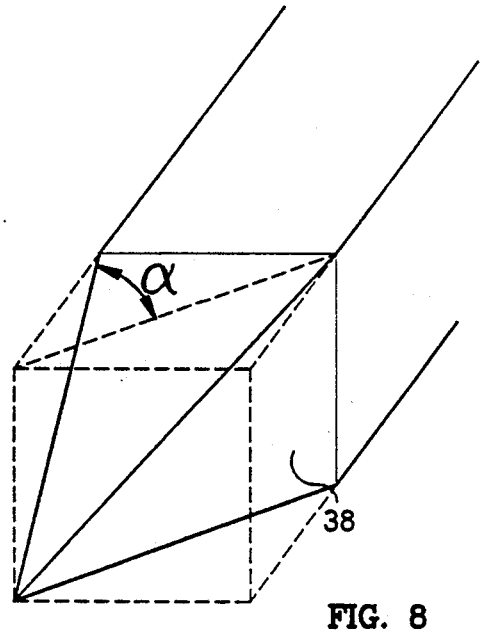
FIG. 8

THINNING SCISSORS

BACKGROUND OF THE INVENTION

1. Field of the Invention

This invention relates to a pair of hair cutting and thinning scissors, and more particularly, to a serrated type of scissors which includes a serrated blade and a non-serrated blade pivoted together.

2. Description of Related Art

Hair cutting and thinning operations are commonly practiced in hair dressing establishments, where a hairdresser or barber uses a hair cutting apparatus known as "thinning scissors". The typical thinning scissors comprises a plain blade, a serrated blade, and means for pivotally joining both blades together. The plain blade normally presents a straight line edge. The serrated blade is provided with a large number of evenly spaced teeth. The thinning scissors allows the user to reduce the bulk of an area of hair without shortening the overall length of hair as seen by an observer.

In the hair thinning operation with the prior art thinning scissors, part of the hair will fall into the interstices between adjacent teeth, and part of the hair will be entrapped in grooves (usually triangularly shaped) at the ends of the teeth. Only the hairs which have been entrapped will be cut, while the hairs which fall into the interstices will be unaffected. This thinning operation will be more clearly understood by reference to FIG. 2 which shows the relationship between the grooves 25 and the interstices 27 in the prior art.

It has generally been assumed that in order to produce lesser thinning effects with the prior art scissors, the size of the interstices must be much larger than that of each groove. This has been put into practice by widening the spacing between the teeth relative to the opening of the grooves, namely the width of each tooth. However, the problem with such an approach is not in designing scissors which would satisfy the structural requirements, but in the fact that with scissors of this type, the serrated blade slides against the non-serrated cutting blade as both blades are brought close, and the two blades no longer engage properly in a thinning action. Thus, even a highly skilled user has difficulty in using wide-spaced thinning scissors to properly achieve certain artistic hair configurations. To date, no scissors that overcome this problem have come into existence.

SUMMARY OF THE INVENTION

In view of the foregoing, it is an object of this invention to provide an improved apparatus capable of cutting and thinning hair in a highly controlled manner.

It is another object of this invention to provide an improved scissors which comprises one blade having a cutting edge and the other blade having a large number of teeth and non-cutting guides arranged therealong so that hair can be thinned in a highly controlled manner by the cutting action of the teeth in cooperation with the guides.

It has now been discovered that if non-cutting guides are aligned alongside the teeth of a serrated blade in the prior art, the non-cutting guides part a tress of hair without severing or damaging the hairs so parted, whereas the teeth effectively cut the remaining hairs in a thinning action. When the teeth and the non-cutting guides are properly designed and spaced apart, this further permits the user to cut hair in predetermined proportions, particularly in lesser amounts than prior art thinning scissors can cut.

In accordance with this invention, there is provided:

a pair of scissors for cutting and thinning hair comprising:

a first blade having a cutting edge; and a second blade pivotally secured to the first blade so as to cooperate with the first blade in a cutting and thinning action, the second blade having a plurality of teeth with cutting ends and a plurality of guides with non-cutting ends, such that the teeth and the guides are spaced longitudinally along the second blade.

BRIEF DESCRIPTION OF THE DRAWINGS

The above objects, as well as further objects, features and advantages of this invention, will be more fully understood by reference to the following detailed description and drawings.

FIG. 5 is a partial enlarged perspective view of one embodiment in accordance with this invention wherein one guide interposes between a pair of teeth so as to leave recessed non-cutting sections on both sides of the guide.

FIG. 6 is a partial enlarged perspective view of another embodiment in accordance with this invention wherein two guides interpose between a pair of teeth so as to leave recessed non-cutting sections on both sides of each guide.

FIG. 7 is a partial enlarged perspective view of a guide included in a pair of scissors in accordance with this invention which shows a taper angle $\alpha$.

FIG. 8 is a partial enlarged perspective view of another guide included in a pair of scissors in accordance with this invention which shows a taper angle $\alpha$.

Like reference numbers in the drawings refer to like elements.

DETAILED DESCRIPTION OF THE INVENTION

Figure 1:
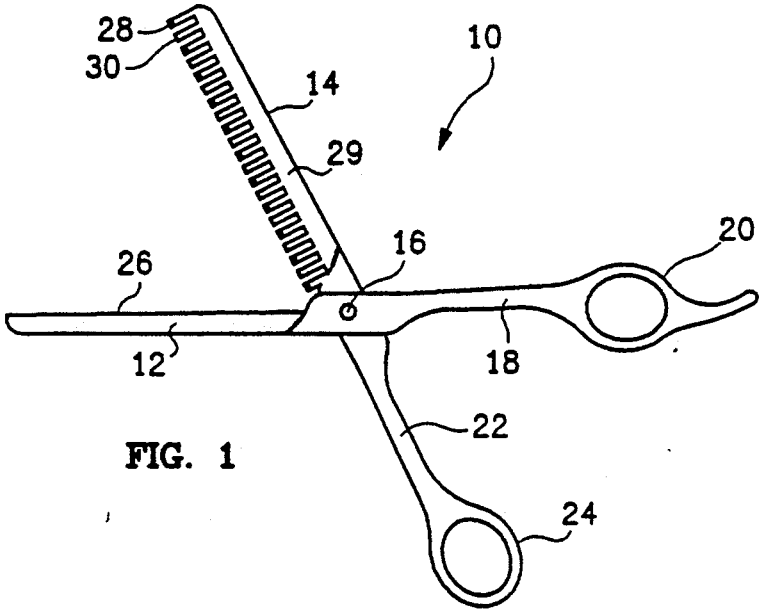
FIG. 1 is a top perspective view of a pair of scissors in accordance with this invention.
Figure 2:
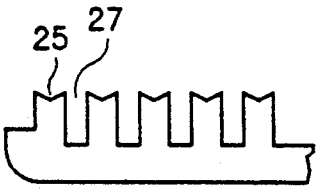
FIG. 2 PRIOR ART
FIG. 2 is a partial enlarged side elevation of a pair of prior art scissors which shows a serrated blade having cutting teeth.

Referring to FIG. 1, there is shown a pair of scissors 10. The pair of scissors 10 comprises a first blade 12, a second blade 14, and a pivot screw 16 for securing the first blade 12 and the second blade 14 together. The first blade 12 has a shank 18 terminating in a first finger loop 20. The second blade 14 has a shank 22 terminating in a second finger loop 24.

The first blade 12 has a beveled cutting edge 26 which is essentially straight. The second blade 14 is serrated and comprises a plurality of teeth 28 and a plurality of guides 30, both of which extend perpendicularly from the body 29 of the blade 14. The first blade 12 and the second blade 14 are held together by the pivot screw 16 to cooperate with each other in a cutting and thinning action.

Figure 3:
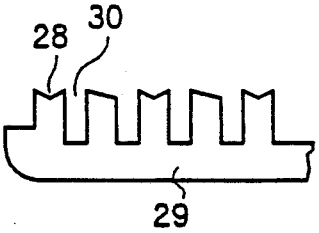
FIG. 3 is a partial enlarged side elevation of a pair of scissors in accordance with this invention which shows a serrated blade having cutting teeth and non-cutting guides.
Figure 4:
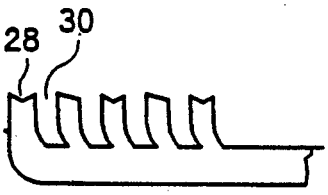
FIG. 4 is a partial enlarged side elevation of a pair of scissors in accordance with this invention which shows a serrated blade having arcuate cutting teeth and arcuate non-cutting guides.

As shown more clearly in FIG. 3, each tooth 28 is of essentially rectangular shape and is parallel to each other or to a neighboring guide 30. Alternatively, each tooth 28 can be arcuate or bowed, as shown in FIG. 4. Each tooth 28 is beveled at its tip, as indicated in FIG. 5, terminating at a cutting end 32. The cutting end 32 is preferably provided with a triangular (or tetrahedral) groove 34. Alternatively, a concave groove 36 may be formed at the cutting end 32, as shown in FIG. 6. Preferably, these grooves are large enough to cover the end of the tooth.

Each guide 30 is also of rectangular shape, and has a non-cutting end 38 or 40. Alternatively, each guide 30 can be arcuate or bowed, as shown in FIG. 4. The non-cutting end 38 is of symmetrical or unsymmetrical pyramid shape that has a blunt point, as shown in FIG. 5. The non-cutting end 40 is beveled to form a chisel shape, and has a blunt edge, as shown in FIG. 6.

The teeth and the guides are spaced apart longitudinally along the second blade 14. As indicated in FIG. 5 and FIG. 6, the second bade 14 is provided with recessed sections 42, which are non-cutting and situated either between a tooth 28 and an adjoining guide 30, or between two adjoining guides. FIG. 5 shows a repeating unit of a preferred embodiment of the second blade 14 wherein a tooth and a guide are alternately aligned. FIG. 6 shows a repeating unit of another preferred embodiment wherein two guides 30 interpose between a pair of neighboring teeth 28. The teeth 28 and the guides 30 are measurably spaced. Preferably, the teeth and guides are spaced evenly apart so that the distances between two adjoining members (tooth-guide, tooth-tooth, or guide-guide) or the widths of the recessed section 40 are approximately equal, as measured longitudinally along the length of the second blade 14. Also, the teeth 28 and guides 30 preferably gradually increase in length from the tip point of the blade toward the pivot screw 16.

The mode operation of the scissors 10 is the same as a pair of the prior art scissors. The user holds the scissors in the usual manner and employs the second blade 14 to comb out hair and achieve an orderly arrangement of the hair for each thinning operation. The first blade 12 cooperates with the second blade 14 to achieve efficient cutting and thinning. Particularly referring to FIG. 5, as the scissors are closed with the two blades 12 and 14 moving toward each other, a portion of the hair to be uncut will slide along the guides 38 into the recessed sections 42, while the remaining hair will be entrapped in the grooves 34. When the two blades are completely brought together, the hairs caught in the recessed sections 40 will remain uncut. The hairs entrapped in the grooves 34 will be cut by a cutting edge 26 in cooperation with a cutting end 32. The purpose of having a blunt point at the trigonal pyramid guide 38 is to prevent hairs from being severed by contact of a guide 38 with a cutting edge 26. The same is true with the chisel shaped guides 40, which are adapted to make the hair slide off easily and, at the same time, not to damage or cut the hair. In order for the guides 30 to smoothly part the hair, the non-cutting end 38 or 40 of each guide preferably has a tapered angle $\alpha$ of about 30 to about 60 degrees (optimally about 45 degrees), as shown in FIG. 7 and FIG. 8, with respect to the side of the guide.

In common serrated scissors of the prior art where teeth are evenly aligned along one of the blades without any guides, approximately equal amounts of hairs are distributed into the recessed sections and into the grooves. Typically, the width of each recessed section is the same as that of each tooth. Consequently, in a cutting action, about 50% of the hairs caught with the blades is cut, leaving the remaining 50% uncut. If thinning of less than 50% is required, the distance between two neighboring teeth should be greater than the width of the individual tooth. However, as indicated earlier, simply widening the gap between the teeth would create a problem: as the two blades are closed, the cutting edge tends not to engage with the teeth, with the result of poor cutting and thinning. Thus, a simple modification to the prior art serrated thinning scissors would not enable the scissors to cut, say 10% or 20% of the hairs combed in a single cutting and thinning action. Therefore, in accordance with one embodiment of this invention, a non-cutting guide 30 is equally distanced from a pair of teeth with the distance being the same as the longitudinal width of the guide, which in turn equals the longitudinal width of a tooth 28. This allows the user to cut about 25% of the hairs combed in a single cutting and thinning action. It will be noted that where even less hair is to be cut, more than two guides 30 should be placed between each pair of teeth 28, as indicated in FIG. 6. In this particular embodiment, each guide 30 is equally distanced from a tooth 28 and from a neighboring guide 30 with the distance being the same as the longitudinal width of a guide 30, which in turn equals the longitudinal width of a tooth 28. Thus, less than 20% hair is expected to be cut.

In view of the above description, it is obvious that the structure of the scissors of this invention accomplishes desired improvements in thinning hair. Further, the invention has other structural advantages, such as the feature by which the blades do not tend to come together in dulling contact during the cutting and thinning operation. A further feature of this invention is the ability to achieve certain hair styles and effects quickly and easily which would previously have required careful and time-consuming use of conventional thinning scissors by a skilled hairdresser.

While preferred specific embodiments of the invention are hereinabove set forth, it should be realized that many alternatives, modifications and variations will be apparent to those skilled in the art of the foregoing description and therefore that the invention is not to be limited to the exact design and constructions illustrated and described therein. Accordingly, the scope of the invention should be determined not by the embodiments detailed but by the appended claims and their legal equivalents.

I claim:

1. A pair of scissors for cutting and thinning hair comprising:

a first blade having a cutting edge, and a second blade pivotally secured to the first blade so as to cooperate with the first blade in a cutting and thinning action, the second blade having a plurality of teeth with cutting ends and a plurality of guides with non-cutting ends such that the teeth and the guides are spaced longitudinally along the second blade.

2. The pair of scissors according to claim 1, wherein the cutting edge of the first blade is a substantially straight line.

3. The pair of scissors according to claim 1, wherein both teeth and guides are of essentially rectangular shape.

4. The pair of scissors according to claim 1, wherein both teeth and guides are of arcuate shape.

5. The pair of scissors according to claim 1, wherein the cutting end of the teeth form a concave groove.

6. The pair of scissors according to claim 1, wherein the cutting end of the teeth form a triangular shaped groove.

7. The pair of scissors according to claim 1, wherein the non-cutting end of the guides is symmetric pyramid shaped.

8. The pair of scissors according to claim 1, wherein the non-cutting end of the guides is unsymmetric pyramid shaped.

9. The pair of scissors according to claim 8, wherein the non-cutting end of the guides has a taper angle $\alpha$ of about 30 to about 60 degrees.

10. The pair of scissors according to claim 1, wherein the non-cutting end of the guides is beveled to form a chisel shape.

11. The pair of scissors according to claim 10, wherein the non-cutting end of the guides has a taper angle $\alpha$ of about 30 to about 60 degrees.

12. The pair of scissors according to claim 11, wherein two guides are aligned between a pair of the teeth.

13. The pair of scissors according to claim 1, wherein the space between one member selected from the teeth and the guides and an adjoining member selected from the teeth and the guides forms a non-cutting recessed section.

14. The pair of scissors according to claim 12, wherein each tooth, guide and non-cutting recessed section all have the same longitudinal width.

15. The pair of scissors according to claim 12, wherein the teeth and the guides are aligned alternately.

16. The pair of scissors according to claim 1, wherein at least one of the guides is aligned between a pair of the teeth.

* * * * *